US008213812B2

(12) United States Patent
Izumi et al.

(10) Patent No.: US 8,213,812 B2
(45) Date of Patent: Jul. 3, 2012

(54) IMAGE FORMING APPARATUS, METHOD OF DETERMINING DETERIORATION DEGREE OF DEVELOPMENT AGENT, AND PROGRAM OF DETERMINING DETERIORATION DEGREE OF DEVELOPMENT AGENT

(75) Inventors: Takao Izumi, Yokohama (JP); Minoru Yoshida, Machida (JP); Hiroshi Murata, Yokohama (JP); Takeshi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 541 days.

(21) Appl. No.: 12/404,503

(22) Filed: Mar. 16, 2009

(65) Prior Publication Data

US 2009/0232525 A1 Sep. 17, 2009

Related U.S. Application Data

(60) Provisional application No. 61/037,049, filed on Mar. 17, 2008.

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS 5,162,849 A * 11/1992 Yoshino et al. ..... 399/29

FOREIGN PATENT DOCUMENTS

| | | | |
|---|---|---|---|
| JP | 07295312 A | * | 11/1995 |
| JP | 09-185177 | | 7/1997 |
| JP | 2005037538 A | * | 2/2005 |
| JP | 2007-271871 | | 10/2007 |

* cited by examiner

*Primary Examiner* — Quana M Grainger
(74) *Attorney, Agent, or Firm* — Turocy & Watson, LLP

(57) ABSTRACT

The present invention provides a technique to accurately grasp a deterioration state of a development agent in a development device, in a development system which supplies a new development agent consisting of a toner and a carrier and discharges an deteriorated development agent to maintain a performance of a development agent in a development device. An image forming apparatus according to the present invention includes a stirring information obtaining section configured to obtain information of a stirring time of the development agent in the development device, a supply information obtaining section configured to obtain information of an amount of the carrier supplied into the development device, and a deterioration degree determining section configured to determine a deterioration degree of the development agent in the development device on the basis of the information obtained by the stirring information obtaining section and the supply information obtaining section.

12 Claims, 13 Drawing Sheets

FIG. 6

PRINT JOB UNIT TWO SHEETS

| | COPIES | | | |
|---|---|---|---|---|
| | 70k | 140k | 210k | 280k |
| PRINT RATIO 2% | ○ | × | — | — |
| PRINT RATIO 3% | ○ | △ | × | — |
| PRINT RATIO 4% | ○ | ○ | △ | × |
| PRINT RATIO 5% | ○ | ○ | ○ | ○ |

FIG. 7

PRINT JOB UNIT FIVE SHEETS

| | COPIES | | | |
|---|---|---|---|---|
| | 70k | 140k | 210k | 280k |
| PRINT RATIO 2% | ○ | △ | × | — |
| PRINT RATIO 3% | ○ | ○ | △ | △ |
| PRINT RATIO 4% | ○ | ○ | ○ | ○ |
| PRINT RATIO 5% | ○ | ○ | ○ | ○ |

FIG. 8

PRINT JOB UNIT TEN SHEETS

| | COPIES | | | |
|---|---|---|---|---|
| | 70k | 140k | 210k | 280k |
| PRINT RATIO 2% | ○ | △ | × | — |
| PRINT RATIO 3% | ○ | ○ | ○ | ○ |
| PRINT RATIO 4% | ○ | ○ | ○ | ○ |
| PRINT RATIO 10% | ○ | ○ | ○ | ○ |

FIG. 9

PRINT JOB UNIT TWO SHEETS

| | COPIES | | | |
|---|---|---|---|---|
| | 70k | 140k | 210k | 280k |
| PRINT RATIO 2% | ○ | ○ | ○ | ○ |
| PRINT RATIO 3% | ○ | ○ | ○ | ○ |
| PRINT RATIO 4% | ○ | ○ | ○ | ○ |
| PRINT RATIO 5% | ○ | ○ | ○ | ○ |

FIG. 10

PRINT JOB UNIT FIVE SHEETS

| | COPIES | | | |
|---|---|---|---|---|
| | 70k | 140k | 210k | 280k |
| PRINT RATIO 2% | ○ | ○ | ○ | ○ |
| PRINT RATIO 3% | ○ | ○ | △ | △ |
| PRINT RATIO 4% | ○ | ○ | ○ | ○ |
| PRINT RATIO 5% | ○ | ○ | ○ | ○ |

FIG. 11

PRINT JOB UNIT TEN SHEETS

| | COPIES | | | |
|---|---|---|---|---|
| | 70k | 140k | 210k | 280k |
| PRINT RATIO 2% | ○ | ○ | ○ | ○ |
| PRINT RATIO 3% | ○ | ○ | ○ | ○ |
| PRINT RATIO 4% | ○ | ○ | ○ | ○ |
| PRINT RATIO 10% | ○ | ○ | ○ | ○ |

IMAGE FORMING APPARATUS, METHOD OF DETERMINING DETERIORATION DEGREE OF DEVELOPMENT AGENT, AND PROGRAM OF DETERMINING DETERIORATION DEGREE OF DEVELOPMENT AGENT

CROSS-REFERENCE TO RELATED APPLICATION

This application is based upon and claims the benefit of priority from: U.S. provisional application 61/037,049, filed of Mar. 17, 2008, the entire contents of which are incorporated herein by reference.

TECHNICAL FIELD

The present invention relates to a technique to determine a change time of a development agent in a development device, in a development system which supplies a new development agent consisting of a toner and a carrier and discharges a deteriorated development agent to maintain a performance of a development agent in a development device.

BACKGROUND

Conventionally, a development system is known, which supplies a new development agent to a development device and discharges an old development agent from the development device to maintain a performance of the development agent in the development device.

In such development system, a technique is known, which mixes a small amount of carrier in a toner cartridge containing a toner supplied to the development device and supplies it together with the toner in order to replace the carrier gradually (for example, see Japanese Patent Application Laid-open No. H09-185177).

However, in the conventional development system, the carrier is supplied to the development device and discharged out of it together with the supply of the toner. Thus, the carrier in the development device is seldom supplied if an output image has a low print ratio, and as a result, the carrier in the development device is not sufficiently replaced. As such, it has a problem that, if the carrier in the development device is not sufficiently replaced, the development agent is deteriorated to generate a poor image quality.

SUMMARY

The embodiments of the present invention are directed to providing a technique to accurately grasp a deterioration state of a development agent in a development device, in a development system which supplies a new development agent consisting of a toner and a carrier and discharges an deteriorated development agent to maintain a performance of a development agent in a development device.

In order to solve the above-described problems, an aspect of the present invention relates to an image forming apparatus, which supplies a new development agent consisting of a toner and a carrier and discharges a deteriorated development agent to maintain a performance of a development agent in a development device, including: a stirring information obtaining section configured to obtain information of a stirring time of the development agent in the development device; a supply information obtaining section configured to obtain information of an amount of the carrier supplied into the development device; and a deterioration degree determining section configured to determine a deterioration degree of the development agent in the development device on the basis of the information obtained by the stirring information obtaining section and the supply information obtaining section.

Also, an aspect of the present invention relates to a method of determining a deterioration degree of a development agent in a development system which supplies a new development agent consisting of a toner and a carrier and discharges a deteriorated development agent to maintain a performance of the development agent in the development device, including: obtaining information of a stirring time of the development agent in the development device; obtaining information of an amount of the carrier supplied into the development device; and determining the deterioration degree of the development agent in the development device on the basis of the obtained information of a stirring time of the development agent and the information of a supply amount of the carrier.

In addition, an aspect of the present invention relates to a program of determining a deterioration degree of a development agent which causes a computer to determine the deterioration degree of the development agent, in a development system which supplies a new development agent consisting of a toner and a carrier and discharges a deteriorated development agent to maintain a performance of a development agent in a development device, the program causing the computer to: obtain information of a stirring time of the development agent in the development device; obtain information of an amount of the carrier supplied into the development device; and determine a deterioration degree of the development agent in the development device on the basis of the obtained information of a stirring time of the development agent and the information of a supply amount of the carrier.

DESCRIPTION OF THE DRAWINGS

FIG. 6 is a data table illustrating a result of a case of not using a sequence of displaying a change time of a development agent according to an embodiment of the present invention;

FIG. 7 is a data table illustrating a result of a case of not using a sequence of displaying a change time of a development agent according to an embodiment of the present invention;

FIG. 8 is a data table illustrating a result of a case of not using a sequence of displaying a change time of a development agent according to an embodiment of the present invention;

FIG. 9 is a data table illustrating a result of a case of using a sequence of displaying a change time of a development agent according to an embodiment of the present invention;

FIG. 10 is a data table illustrating a result of a case of using a sequence of displaying a change time of a development agent according to an embodiment of the present invention;

FIG. 11 is a data table illustrating a result of a case of using a sequence of displaying a change time of a development agent according to an embodiment of the present invention;

DETAILED DESCRIPTION

Hereinafter, embodiments of the present invention will be described with reference to the accompanying drawings.

Figure 1:
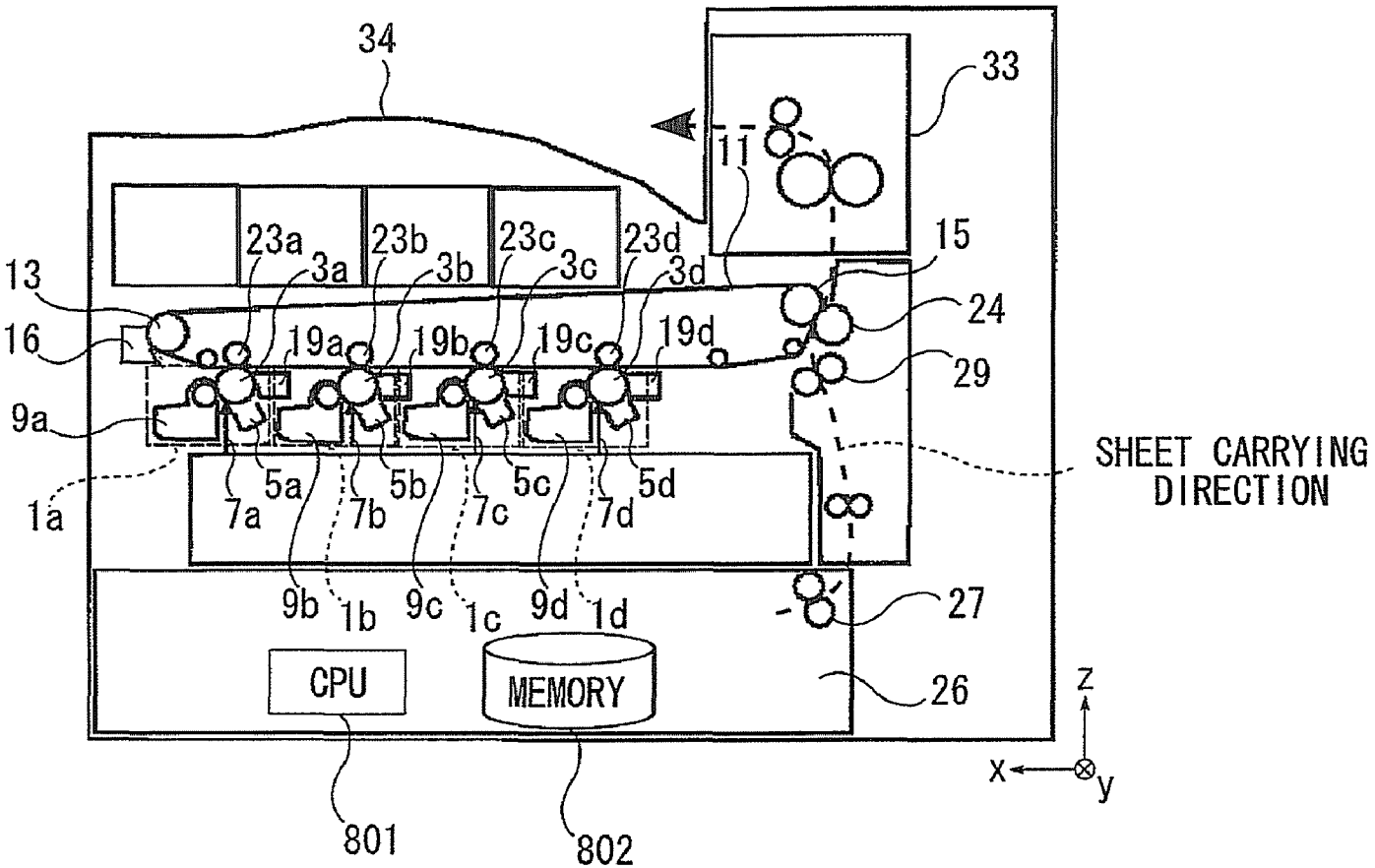
FIG. 1 is a longitudinal cross-sectional view illustrating a schematic configuration of an image forming apparatus including a deterioration degree determining device of development agent according to an embodiment of the present invention.

FIG. 1 is a longitudinal cross-sectional view illustrating a schematic configuration of an image forming apparatus (MFP (Multi Function Peripheral)) including a deterioration degree determining device of development agent according to an embodiment of the present invention.

The image forming apparatus according to this embodiment includes process units 1*a*, 1*b*, 1*c* and 1*d*.

The respective process units 1*a*, 1*b*, 1*c* and 1*d* have photoconductive drums 3*a*, 3*b*, 3*c* and 3*d* which are image carriers, and development agent images are formed on such photoconductive members.

Herein, the process unit 1*a* as a representative of the four process units 1*a* to 1*d* will be described. The photoconductive drum 3*a* has a cylindrical shape of which a diameter is 30 mm and is provided rotatably in a clockwise direction in FIG. 1.

The following elements are disposed around the photoconductive drum 3*a* along the rotational direction. First, a charger 5*a* is provided opposite to a surface of the photoconductive drum 1*a*. This charger 5*a* uniformly charges a photoconductive surface of the photoconductive drum 3*a* with a negative polarity (−). An exposure device 7*a* for exposing the charged photoconductive drum 3*a* to light to form an electrostatic latent image on the photoconductive drum 3*a* is provided in the downstream of a moving direction of the photoconductive surface of the charger 5*a*. In addition, a development device 9*a* is provided in the downstream of a moving direction of the photoconductive surface of the exposure device 7*a*, and contains a yellow development agent and reversely develops the electrostatic latent image formed by the exposure device 7*a* using such development agent. An intermediate transfer belt 11 which is an image forming medium is installed so as to contact with the photoconductive surface of the photoconductive drum 3*a*.

A cleaner 19*a* is provided in the downstream of the position (so-called a primary transfer position) where the photoconductive drum 3*a* contacts with the belt 11. The cleaner 19*a* removes surface charges of the photoconductive drum 3*a* by a uniform light-irradiation after transfer of the development agent image onto the belt 11, and simultaneously removes and contains a toner remaining on the photoconductive member.

Thereby, one cycle for forming an image is completed, and, in a subsequent image forming process, the charger 5*a* uniformly charges an uncharged photoconductive drum 3*a* again.

Specifically, the process unit 1*a* includes the above-described photoconductive drum 3*a*, the charger 5*a*, the exposure device 7*a*, the development device 9*a* and the cleaner 19*a*.

The belt 11 has a length (width) almost the same as a length of the photoconductive drum 1*a*, in a direction (depth direction of the figure) orthogonal to a sheet carrying direction (refer to the broken arrow shown in FIG. 1). The belt 11 has a seamless shape. The belt 11 is wound around and hangs on a driving roller 15, which rotates and moves the belt at a predetermined speed, and several driven rollers (for example, a roller 13).

The belt 11 is made of polyimide which is 100 μm thick and where carbons are uniformly dispersed. The belt has an electric resistance of $10^9$ Ωcm and semi-conductivity.

As a substance of the belt 11, for example, a material which has semi-conductive material having a volume resistance of $10^8$ to $10^{11}$ Ωcm can be employed. Specifically, polyethyleneterephthalate, polycarbonate, polytetrafluoroethylene, polyvinylidene fluoride and so forth in which conductive particles such as carbons and the like are dispersed may be used, as well as the polyimide in which carbons are dispersed.

Instead of using conductive particles, polymer film whose electric resistance is adjusted by coordinating compositions may be used. Further, such polymer film to which ion conductive substance is mixed or rubber substance having a relatively low electric resistance, such as silicon rubber urethane rubber or the like may be employed.

In addition to the process unit 1*a*, the process units 1*b*, 1*c* and 1*d* are disposed between the driving roller 15 and the roller 13 on the belt 11 along the carrying direction of the belt 11.

The process units 1*b*, 1*c* and 1*d* all have the same configurations as the process unit 1*a*. In other words, the photoconductive drums 3*b*, 3*c* and 3*d* are provided nearly at the respective centers of the process units 1*b*, 1*c* and 1*d*. The chargers 5*b*, 5*c* and 5*d* are provided around the photoconductive drums 3*b*, 3*c* and 3*d*, respectively. The exposure devices 7*b*, 7*c* and 7*d* are provided in the downstream of a moving direction a photoconductive surface of the chargers. The development devices 9*b*, 9*c* and 9*d* and the cleaners 19*b*, 19*c* and 19*d* are provided in the downstream of the exposure devices in the same configuration as the process unit 1*a*.

The development devices 9*b* to 9*d* contain development agents of colors different from the development device 9*a*. Specifically, the development device 9*b* contains a magenta development agent, the development device 9*c* contains a cyan development agent and the development device 9*d* contains a black development agent.

The belt 11 sequentially contacts with the respective photoconductive drums 3*a*, 3*b*, 3*c* and 3*d*.

Transfer devices 23*a*, 23*b*, 23*c* and 23*d* are provided corresponding to the respective photoconductive drums in the vicinity of the position where the belt 11 contacts with the respective photoconductive drums 3*a*, 3*b*, 3*c* and 3*d*. That is, the transfer devices 23 are provided in contact with the rear side of the belt 11 in an upward direction of the corresponding photoconductive drums and face the process units through the belt 11.

The transfer member 23*a* is connected to a not-shown direct current ("DC") power source 25*a* which is a voltage supplier and has a positive polarity (+). Likewise, the transfer members 23*b*, 23*c* and 23*d* are connected to not-shown DC power sources 25*b*, 25*c* and 25*d*, respectively.

Meanwhile, a paper feeding cassette 26 for containing papers P is provided in the downstream of the image forming unit as shown in FIG. 1. A main body of the image forming apparatus is provided with a pickup roller 27 that picks up the papers P one by one from the paper feeding cassette 26. A resist roller pair 29 is rotatably provided in the vicinity of the secondary transfer roller. The resist roller pair 29 feeds the paper P to the secondary transfer roller and a secondary transfer unit which the secondary transfer roller faces interposing the belt therebetween, at a predetermined timing.

In addition, as shown in FIG. 1, a fixing device 33 for heating and fixing the development agents transferred onto the papers P onto the papers P and a paper discharge unit 34 where the papers P fixed by the fixing device 33 are discharged are provided in the right of belt 11.

A CPU 801 conducts a variety of processings (including a management of a print job) in the image forming apparatus according to this embodiment and also realizes a variety of functions by executing programs stored in a memory 802. The memory 802 may consist of, for example, a RAM (Random Access Memory), a ROM (Read Only Memory), a DRAM (Dynamic Random Access Memory), an SRAM (Static Random Access Memory), a VRAM (Video RAM), or the like and stores various information and programs used by the image forming apparatus according to the present embodiment.

An operation flow of forming a color image in the image forming apparatus configured as described above will now be described.

When receiving a command of an image forming start, the photoconductive drum 3*a* begins to rotate receiving a driving force from a not-shown driving mechanism. The charger 5*a* uniformly charges a photoconductive surface of the photoconductive drum 3*a* with about −600V. The exposure device 7*a* irradiates a photoconductive surface of the photoconductive drum 3*a* uniformly charged by the charger 5*a* with light according to an image to be recorded, thereby forming an electrostatic latent image thereon.

The development device 9*a* contains a two-component development agent consisting of a yellow (Y) toner and a ferrite carrier, applies a bias value of −380V to a not-shown development sleeve by use of a not-shown development bias power source, and generates a development electric field between itself and the photoconductive drum 3*a*. A Y toner charged with a negative polarity is attached on a region of a potential (higher potential part) of an image part of the electrostatic latent image of the photoconductive drum 3*a* (so-called "reverse development").

Subsequently, the development device 9*b* develops an electrostatic latent image using a magenta (M) toner and forms a magenta toner image on the photoconductive drum 3*b*. At this time, the magenta toner has an average particle diameter of about 7 μm like the yellow toner and is charged with a negative polarity due to tribo-charging of it and ferrite magnetic carrier particles (not shown) having an average particle diameter of about 60 μm. A development bias value is about −380V like the development device 3*a* and the development bias voltage is applied to the development sleeve (a structure of the development device is the same as the development device 9*a*) using the not-shown bias power source. A direction of the development electric field is from the surface of the photoconductive drum 3*b* to the development sleeve in the image part, and the negative-charged magenta toner is attached to a higher potential part of a latent image.

A bias voltage of about +1000V is applied to the transfer member 23*a* in a transfer region Ta formed by the photoconductive drum 3*a*, the belt 11 and the transfer member 23*a*. Thereby, a transfer electric field is generated between the transfer member 23*a* and the photoconductive drum 3*a*, and the yellow toner image on the photoconductive drum 3*a* is transcribed onto the belt 11 according to this transfer electric field.

The transfer devices will be described more in detail.

The transfer device 23*a* is a conductive foamy urethane roller in which carbons are dispersed to become conductive. The roller is formed to have a core of ϕ10 mm and outer diameter of ϕ18 mm. An electric resistance between surfaces of the core and the roller is about $10^6\Omega$. The core is connected to a constant-voltage DC power source.

A power supply device in the transfer devices is not limited to the roller but may be a conductive brush, a conductive rubber blade, a conductive sheet or the like. The conductive sheet herein may be carbon-dispersed rubber substance or resin film, or may be rubber substance such as silicon rubber, urethane rubber, EPDM or the like, or resin substance such as polycarbonate or the like. A volume resistance value of the conductive sheet is preferably $10^5$ to $10^7$ Ωcm.

Springs for urging a roller shaft are provided at both ends of the roller shaft which is a rotational axis of the transfer roller 23*a*. The transfer roller 23*a* is urged so as to elastically contact with the carrying belt 11 in a vertical direction, by the springs. Herein, an intensity of an urging force due to the springs for urging each of the transfer rollers is assumed to be 600 gft. Here, the "urging force" refers to a resultant force of an urging force of 300 gft due to the first spring and an urging force of 300 gft due to the second spring.

The transfer devices 23*b*, 23*c* and 23*d* have the same configurations as the transfer device 23*a* described above and further the configuration of elastically contacting with the carrying belt 11 is also the same for each transfer device; thus, the description of configurations of which will be omitted.

An image on the belt 11 where the Y (yellow) toner image is transferred in the above-described transfer region Ta is carried toward the transfer region Tb formed by the photoconductive drum 3*b*, the belt 11 and the transfer member 23*b*. In the transfer region Tb, the magenta toner image overlaps and is transferred on the belt 11 one layer more by applying a bias voltage of about +1200V to the transfer member 23*b* from a DC power source.

Successively, the cyan development agent image overlaps and is transferred onto the development agent images which have been already transferred on the belt 11, by applying a bias voltage of about +1400V to the transfer member 23*c* in a transfer region Tc formed by the photoconductive drum 3*c*, the belt 11 and the transfer member 23*c*.

The black development agent image overlaps and is transferred onto the development agent images which have been already transferred on the belt 11, by applying a bias voltage of about +1600V to the transfer member 23*d* in a transfer region Td formed by the photoconductive drum 3*d*, the belt 11 and the transfer member 23*d*.

In the meantime, the pickup roller 27 extracts the papers P from the paper feeding cassette 26, and the resist roller pair 29 feeds these papers P to the secondary transfer unit.

In the secondary transfer unit, a predetermined bias voltage is applied to the secondary transfer roller 24 to then generate a transfer electric field between it and the secondary transfer roller 24 interposing the belt 11, thereby the multiple color toner images on the belt 11 are transferred onto the paper P at one time.

As such, the respective color development agent images transferred at one time on the paper P are fixed on the paper P by the fixing device 33, to form a color image. The papers P after completion of the fixing are discharged to the paper discharge unit 34.

Figure 2:
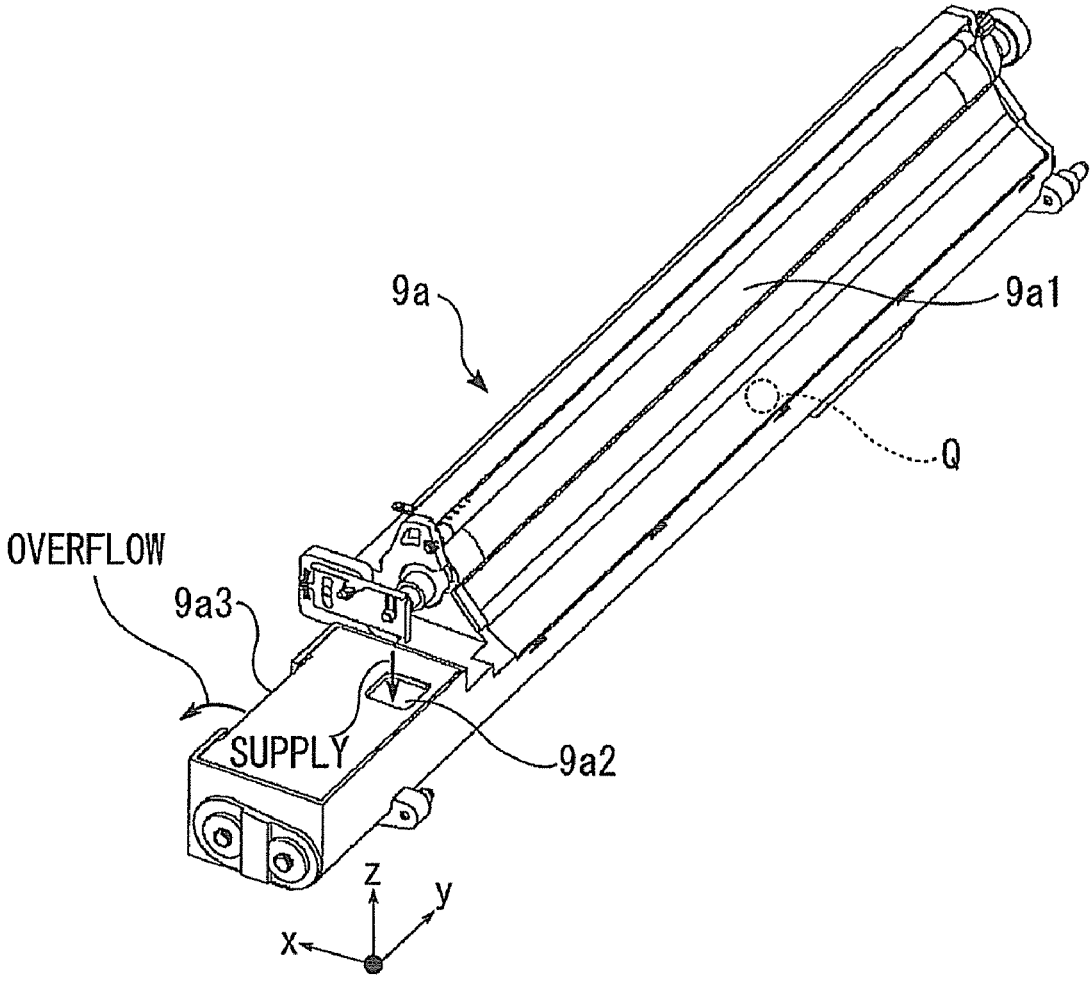
FIG. 2 is a general perspective view illustrating a schematic configuration of a development device in the image forming apparatus according to an embodiment of the present invention.
Figure 3:
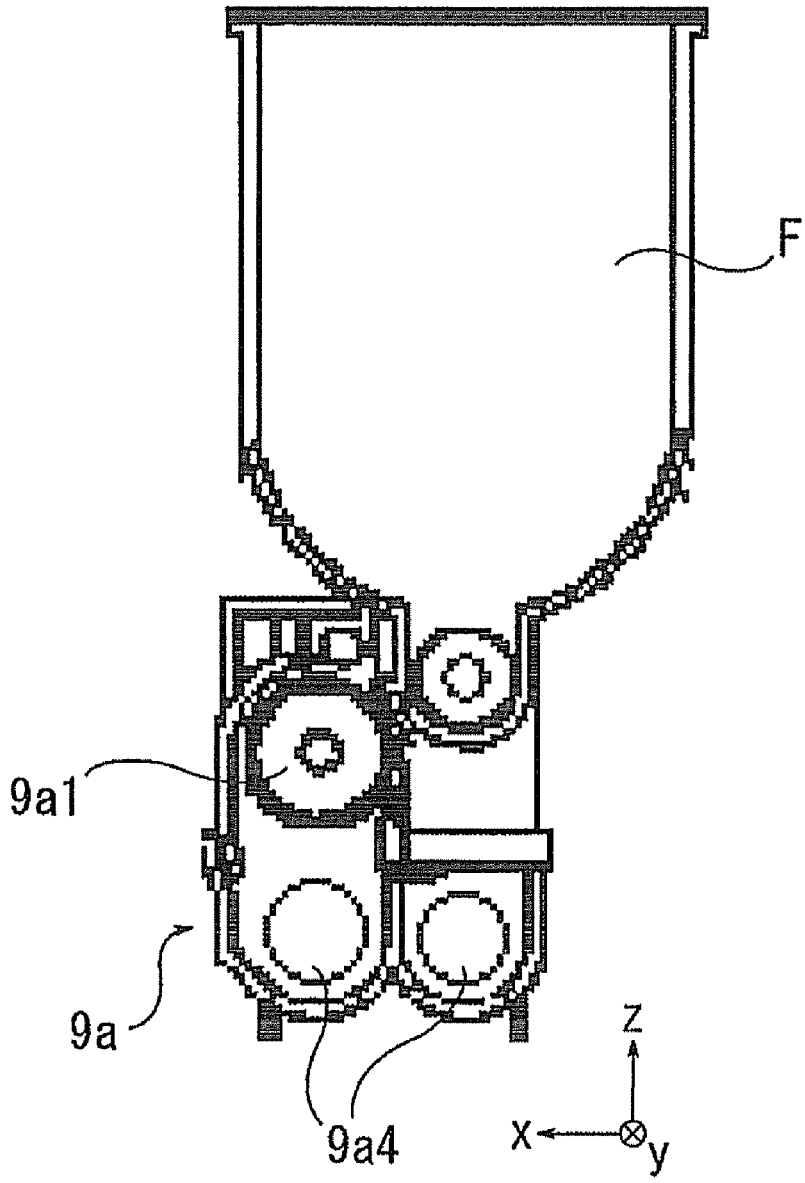
FIG. 3 is a longitudinal cross-sectional view illustrating a schematic configuration of a development agent cartridge in the image forming apparatus according to an embodiment of the present invention.

FIG. 2 is a general perspective view illustrating a schematic configuration of the development device in the image forming apparatus according to an embodiment of the present invention, and FIG. 3 is a longitudinal cross-sectional view illustrating a schematic configuration of a development agent cartridge in the image forming apparatus according to an embodiment of the present invention.

When a development agent image is formed on the photoconductive drum and in turn a toner concentration of the development agent (yellow toner) in the development device 9*a* is lowered, a toner concentration sensor Q senses it and a yellow toner is supplied into the development device 9*a* from the development agent cartridge F, to constantly maintain a toner concentration in the development device 9*a*. In addition, a carrier is also supplied into the development device 9*a* from the development agent cartridge F together with the toner via a development agent supply port 9*a*2, the development agent overflows out of a development agent discharge port 9*a*3 as much as such supply to discharge the development agent, thus, an amount of a development agent in the development device is maintained at a constant level and also an older and deteriorated carrier in the development device is replaced with a new carrier gradually.

Figure 4:
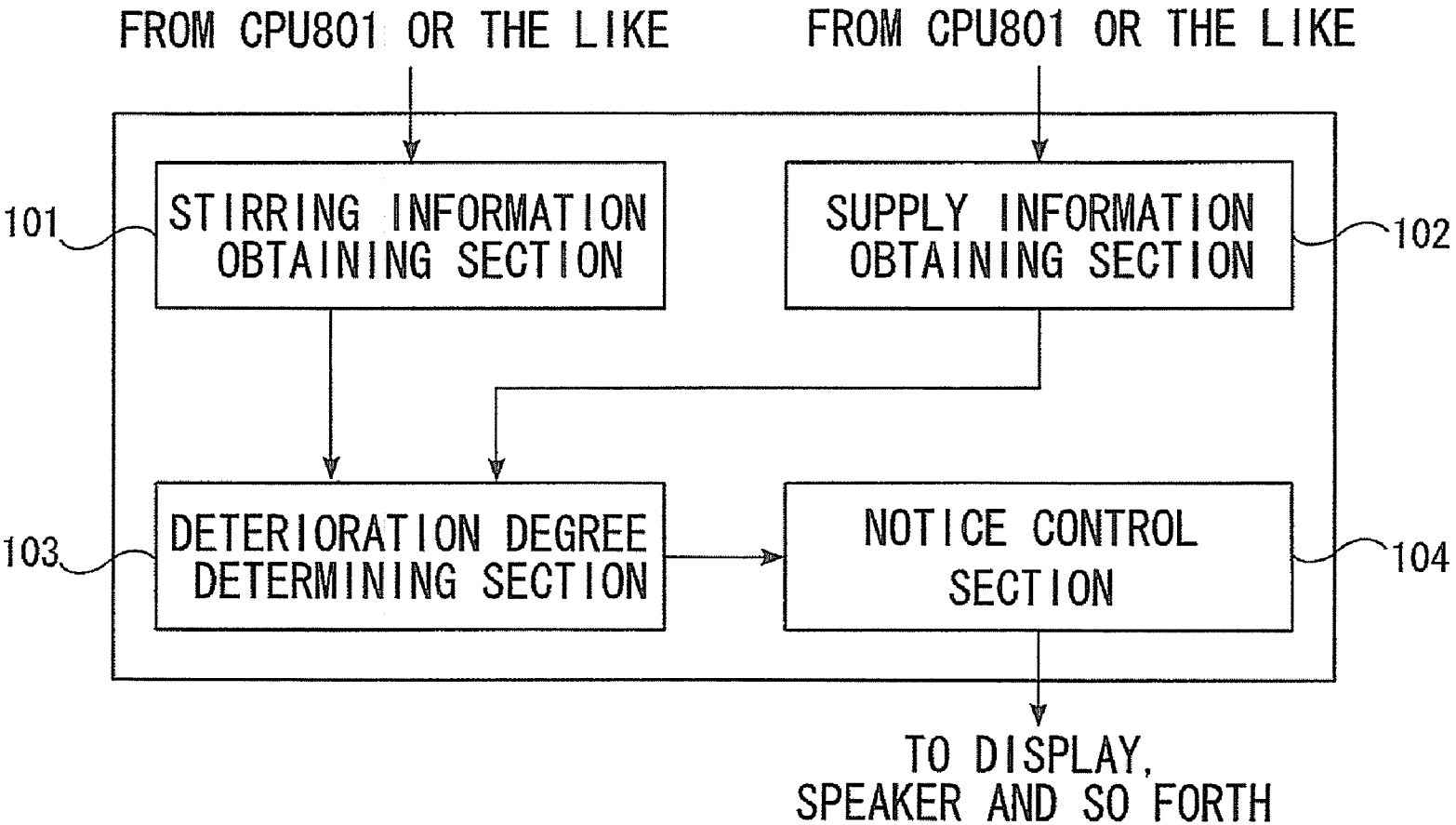
FIG. 4 is a functional block diagram explaining the deterioration degree determining device of development agent according to an embodiment of the present invention.

FIG. 4 is a functional block diagram explaining the deterioration degree determining device of development agent according to the present embodiment.

The deterioration degree determining device of development agent according to the present embodiment includes a stirring information obtaining section 101, a supply information obtaining section 102, a deterioration degree determining section 103 and a notice control section 104.

The stirring information obtaining unit 101 obtains information of a stirring time of the development agent in the development device.

The supply information obtaining section 102 obtains information of an amount of a carrier supplied into the development device.

The deterioration degree determining section 103 determines a deterioration degree of the development agent in the development device, based on the information obtained by the stirring information obtaining section 101 and the supply information obtaining section 102. Specifically, for example, the deterioration degree determining section 103 determines a deterioration degree is high if a stirring time of the development agent is long, and determines the deterioration degree is low if a supply amount of the carrier is large.

The notice control section 104 notifies a user that the development agent contained in the development device reaches a change time, when the deterioration degree determined by the deterioration degree determining section 103 exceeds a predetermined level. Here, the notice may be given by being displayed on a screen of a not-shown display unit which is typically equipped in the image forming apparatus, or may be given by sound out of a not-shown speaker which is typically equipped in the image forming apparatus. The notice to a user by the notice control section 104 may be given by a message transmission using an e-mail or a facsimile.

Specifically, the information of a stirring time of the development agent obtained by the stirring information obtaining section 101 is at least any one of "an accumulated driving time counter value of the development device" and "an accumulated copies counter value." The information of a supply amount of the carrier obtained by the supply information obtaining section 102 is at least any one of "an accumulated driving time counter value of the development agent supply cartridge," "an average print ratio of an image forming process performed using the development device" and "an accumulated print pixel count value of an image forming process performed using the development device."

Figure 5:
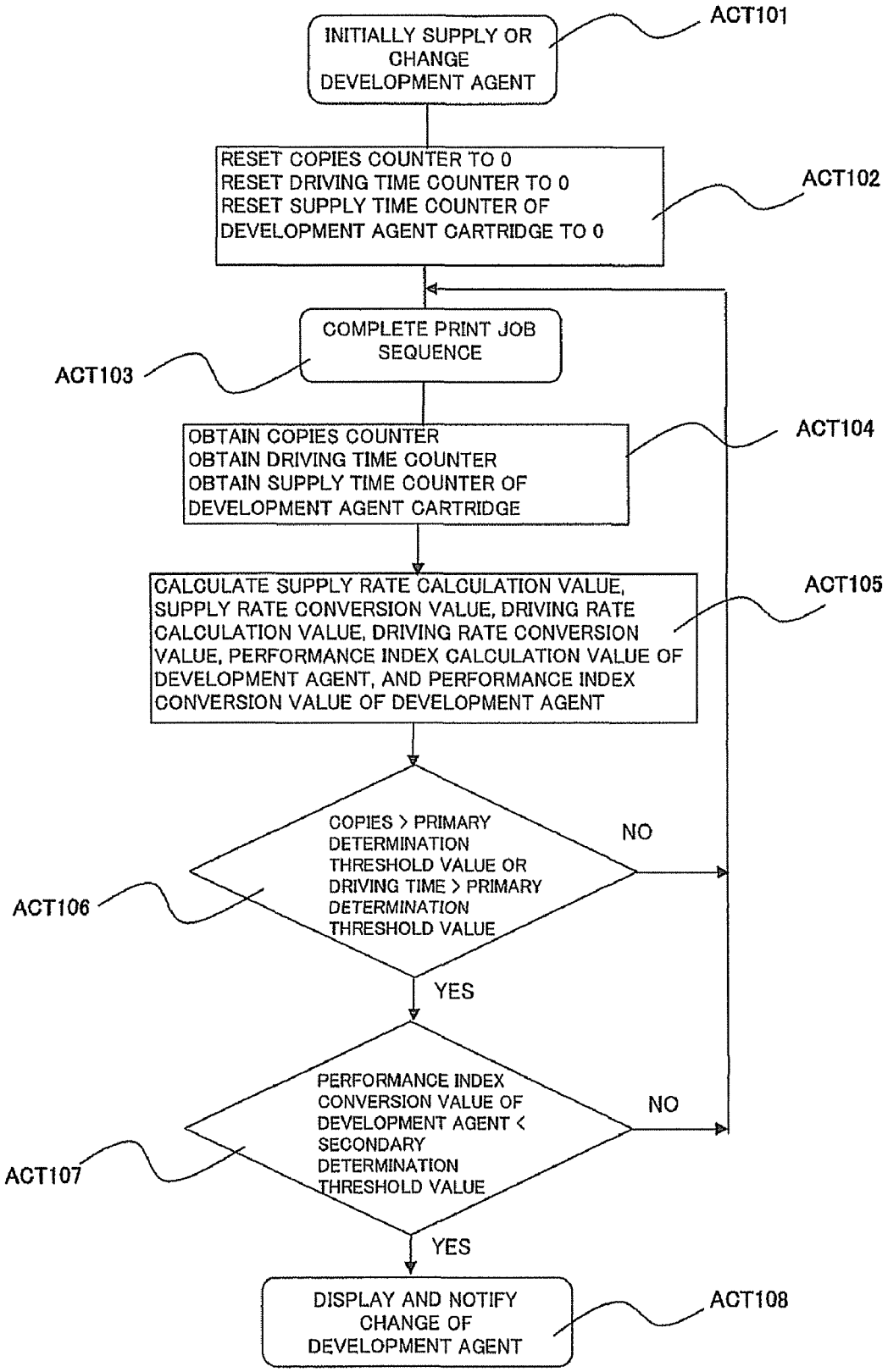
FIG. 5 is a flowchart illustrating flows in a deterioration degree determining process of development agent according to an embodiment of the present invention.

Hereinafter, a process by the image forming apparatus including the deterioration degree determining device according to the embodiment of the present invention will be described in detail. FIG. 5 is a flowchart illustrating flows in a deterioration degree determining process of development agent according to the embodiment of the present invention.

In a method of determining a deterioration degree of the development agent according to this embodiment, three counters are used basically such as:

(1) A counter for counting copies for each color, (2) A counter for counting a driving time of the development device of each color, and (3) A counter for counting a driving time of a motor which supplies the development agent to the development device. The three counters can be counted by, for example, the CPU 801.

The counter for counting a driving time of the development device counts once every 2 sec. The counter for counting a driving time of the motor which supplies the development agent to the development device counts once every 12 msec.

First, when a development agent of the development device of each color is changed (ACT 101), the three counters are automatically reset by an initial operation (for example, a toner concentration adjusting operation) of each development device (ACT 102). of course, if not automatically reset, the reset may be performed manually by a service man upon changing development agents.

If a print sequence is performed and then completed (ACT 103), the stirring information obtaining section 101 and the supply information obtaining section 102 firstly obtain current values of the three counters (ACT 104).

Subsequently, the deterioration degree determining section 103 calculates a supply rate calculation value, a driving rate calculation value and a performance index calculation value of the development agents by use of the counter values (ACT 105).

Furthermore, the deterioration degree determining section 103 calculates a supply rate conversion value, a driving rate conversion value and a performance index conversion value of the development agent by taking a rate of the respective calculation values, to a preset supply rate reference value, a preset driving rate reference value and a preset performance index reference value of the development agent (ACT 105). The preset supply rate reference value, the preset driving rate reference value and the preset performance index reference value of the development agent may be stored in the memory 802, for example.

<Method of Calculating Supply Rate Calculation Value>

Black toner (*K*) supply rate calculation value=(supply time counter value of the development agent cartridge (*K*))/(copies counter value of the development agent (*K*))×100

Yellow toner (*Y*) supply rate calculation value=(supply time counter value of the development agent cartridge (*Y*))/(copies counter value of the development agent (*Y*))×100

Magenta toner (*M*) supply rate calculation value=(supply time counter value of the development agent cartridge (*M*))(copies counter value of the development agent (*M*))×100

Cyan toner (*C*) supply rate calculation value=(supply time counter value of the development agent cartridge (*C*))/(copies counter value of the development agent (*C*))×100

Here, the supply rate calculation value corresponds to an amount of development agents supplied to the development devices per copy and is an index for determining how much the development agents are refreshed. The driving rate calculation value corresponds to a driving time of the development devices per copy and is an index for determining how much the development agents are deteriorated.

The performance index calculation value of the development agent is a ratio of the supply rate calculation value to the driving rate calculation value, represents how much the development agents are refreshed or deteriorated and is an index to represent a performance of the development agent.

That is, a performance of the development agent is maintained close to its initial state as the performance index calculation value of the development agent is larger and deterioration of the development agent advances as it becomes smaller.

In addition, the following reference value for each of the calculation values is set for the development device of each color.

Supply rate reference value=(supply time count reference value of development agent cartridge)/(life copies of development agent which is not changed)×100

Driving rate reference value=(driving time count reference value of development device)/(life copies of development agent which is not changed)×100

Performance index reference value of development agent=(supply time count reference value of development agent cartridge)/(driving time count reference value of development device)×100

Here, the supply rate reference value represents a rate of a driving time count (supply time count reference value of development agent cartridge) of a supply motor which supplies a development agent corresponding to a capacity of one development device to a development device, to a copies count (life copies of a development agent which is not changed) until a performance of the development agent reaches a change level without supply of the carrier, by a percentage.

In this embodiment, it is assumed that all of four colors have the same setting, the copies count until a performance of the development agent reaches a change level without supply of the carrier is 140000, the driving time count of the supply motor which supplies a development agent corresponding to a capacity of one development device to a development device is 432000. Thus, the supply rate reference value is 309.

In addition, the driving rate reference value represents a rate of a driving time count (driving time count reference value of development device) of the development device, taken to print the above-described copies, to a copies count (life copies of a development agent which is not changed) until a performance of the development agent reaches a change level without supply of the carrier, by a percentage. Here, it is assumed that the driving time of the development device is a value in an operation mode in which a print stops after printing five sheets and then resumes, not a continuous print.

In this embodiment, it is assumed that all of four colors have the same setting, the copies count until a performance of the development agent reaches a change level without supply of the carrier is 140000, the driving time count of the development device taken to print the above-described copies is 130000. Thus, the driving rate reference value is 93.

In addition, the performance index reference value of the development agent represents a rate of the driving time count (supply time count reference value of the development agent cartridge) of the supply motor which supplies a development agent corresponding to a capacity of one development device to a development device, to the driving time count (driving time count reference value of development device) of the development device, taken to print copies until a performance of the development agent reaches a change level without supply of the carrier, by a percentage.

Here, it is assumed that the driving time of the development device is a value in an operation mode (so-called an intermittent operation) in which a print stops after printing five sheets and then resumes, not a continuous print. In this embodiment, the performance index reference value of development agent is 332.

A rate of the calculation value to the reference value is represented by a percentage using the calculation value and the reference value and is taken as a supply rate conversion value, a driving rate conversion value and a performance index conversion value of the development agent for each color. Equations to calculate the conversion values are as follows.

<Supply Rate Conversion Value>

Black toner (*K*) supply rate conversion value=(*K* toner supply rate calculation value/*K* toner supply rate reference value)×100

Yellow toner (*Y*) supply rate conversion value=(*Y* toner supply rate calculation value/*Y* toner supply rate reference value)×100

Magenta toner (*M*) supply rate conversion value=(*M* toner supply rate calculation value/*M* toner supply rate reference value)×100

Cyan toner (*C*) supply rate conversion value=(*C* toner supply rate calculation value/*C* toner supply rate reference value)×100

<Driving Rate Conversion Value>

Black toner (*K*) driving rate conversion value=(*K* toner driving rate calculation value)/(*K* toner driving rate reference value)×100

Yellow toner (*Y*) driving rate conversion value=(*Y* toner driving rate calculation value)/(*Y* toner driving rate reference value)×100

Magenta toner (*M*) driving rate conversion value=(*M* toner driving rate calculation value)/(*M* toner driving rate reference value)×100

Cyan toner (*C*) driving rate conversion value=(*C* toner driving rate calculation value)/(*C* toner driving rate reference value)×100

<Performance Index Conversion Value of Development Agent>

Performance index conversion value of black (*K*) development agent=(performance index calculation value of *K* development agent)/(performance index reference value of *K* development agent)×100

Performance index conversion value of yellow (*Y*) development agent=(performance index calculation value of *Y* development agent)/(performance index reference value of *Y* development agent)×100

Performance index conversion value of magenta (*M*) development agent=(performance index calculation value of *M* development agent)/(performance index reference value of *M* development agent)×100

Performance index conversion value of cyan (*C*) development agent=(performance index calculation value of *C* development agent)/(performance index reference value of *C* development agent)×100

Here, the meaning of the supply rate conversion value being 100 is that a reference amount of a carrier per copies is supplied to the development device and then the development agent is refreshed. The meaning of the supply rate conversion value being below 100 is that there is a possibility of the development agent being not sufficiently refreshed since a reference amount of the carrier per copies is not supplied to the development device. In addition, the meaning of the supply rate conversion value being over 100 is that the development agent is sufficiently refreshed since more than a reference amount of the carrier per copies is supplied to the development device.

Likewise, the meaning of the driving rate conversion value being 100 is that the development device works for a reference driving time per copies and thus a carrier is deteriorated up to a reference level. The meaning of the driving rate conversion value being below 100 is that the development device works for less than a reference driving time per copies and thus a carrier is not deteriorated up to the reference level. In addition, the meaning of the driving rate conversion value being over 100 is that the development device works for a longer time than the reference driving time and thus a carrier per copies is deteriorated up to more than the reference level.

The meaning of the performance index conversion value of the development agent being 100 is that deterioration of the carrier due to a driving of the development device and refresh of the carrier due to its supply are in balance and thus a reference deterioration level is maintained. The meaning of the performance index conversion value of the development agent being below 100 is that the deterioration level of the development agent is higher than a reference value since the refresh of the carrier due to its supply is less than the deterioration of the carrier due to the driving of the development device. The meaning of the performance index conversion value of the development agent being over 100 is that the deterioration level of the development agent is lower than the reference value since the refresh of the carrier due to its supply is more than the deterioration of the carrier due to the driving of the development device. The development agents need to be changed when the performance index conversion value of the development agent is below 100.

The sequence thereof will be described again.

When the supply rate calculation value, the driving rate calculation value, the performance index calculation value of the development agent, the supply rate conversion value, the driving rate conversion value and the performance index conversion value of the development agent are calculated (ACT 105), it is firstly determined whether or not a numerical value of the copies counter or the driving time counter of the development device is more than a primary determination threshold value (ACT 106).

In this embodiment, the primary determination value of the copies is 70000, for example, and the primary determination threshold value of the driving time of the development device is 65000, for example. Here, it is assumed that the driving time of the development device is a value in an operation mode (so-called an intermittent operation) in which a print stops after printing five sheets and then resumes, not a continuous print.

If the numerical value of the copies counter or the driving time counter of the development device is below the primary determination threshold value (ACT 106, No), nothing is performed until a subsequent print sequence (ACT 103). When the numerical value of the copies counter or the driving time counter of the development device is equal to or more than the primary determination threshold value (ACT 106, Yes), a secondary determination is conducted.

In the secondary determination, the performance index conversion value of the development agent previously calculated is compared with a secondary determination threshold value, to secondly determine whether or not it is below the secondary determination threshold value (ACT 107). The secondary determination threshold value is herein, for example, 100.

When the performance index conversion value of the development agent is equal to or more than the secondary determination threshold value (ACT 107, No), it means that refresh of the carrier due to supply of the development agent is more than deterioration of the carrier due to a driving of the development device. That is, a deterioration level of the development agent is lower than the reference value, thus, nothing is performed particularly until a subsequent print sequence (ACT 103).

When the performance index conversion value of the development agent is below the secondary determination threshold value, it means that the deterioration level of the development agent is equal to or more than the reference value since refresh of the carrier due to its supply is less than deterioration of the carrier due to a driving of the development device. In this case, since development agents need to be changed, a message is displayed on a control panel in order to notify a service man that it is a change time of the development agents. In addition, the same message is simultaneously notified to an administrator by e-mail (ACT 108). Even after display of the message, a print operation is made possible to wait for the change of the development agents by a service man. When a service man changes development agents, the above-described three counters are automatically reset due to an initial operation (for example, a toner concentration adjusting operation) or the like of each development device. If not automatically reset, the reset may be made manually upon changing the development agents.

In a case of using the deterioration degree determining method of development agents according to this embodiment and a case of not using it, a state of a toner scattering or an image quality is compared by an actual print using an image forming apparatus. Parameters used for the test include (1) a print ratio (2% to 5%) of a print object and (2) unit copies of a print JOB (two sheets, five sheets and ten sheets), and a state of a toner scattering from the development devices is checked every 70 k (where, k represents 1000 and thus 70 k means 70000 sheets) sheets while the print continues.

FIGS. 6 to 8 are data tables illustrating a result of a case of not using the sequence of displaying the change time of the development agents according to the embodiment of the present invention. In FIGS. 6 to 8, "O" represents no or a little toner scattering occurred, "Δ" represents that a toner scattering occurred, however, there was no problem with an image, and "X" represents that a toner scattering occurred and there was a problem with an image.

FIG. 6 shows a result of a case of a print JOB unit being two sheets, FIG. 7 shows a result of a case of a print JOB unit being five sheets and FIG. 8 shows a result of a case of a print JOB unit being ten sheets.

FIGS. 9 to 11 are data tables showing a result of a case of using the sequence of displaying the change time of the development agents according to the embodiment of the present invention.

In the case of not using the sequence of displaying the change time of the development agents according to this embodiment, it can be known that there is a toner scattering, an image quality is also deteriorated and thus an image quality is not maintained.

In contrast, in the case of using the sequence of displaying the change time of the development agents according to this embodiment, under the condition shown in FIG. 9, the change message is displayed on a screen at about 100 k sheets in the print ratio of 2%, is displayed on the screen at about 160 k sheets in the print ratio of 3% and is displayed on the screen at about 230 k in the print ratio of 4%. Also, under the condition shown in FIG. 10, the change message is displayed on the screen at about 160 k sheets in the print ratio of 2%. Under the condition shown in FIG. 11, the change message is displayed on the screen at about 180 k sheets in the print ratio of 2%.

As such, by using the sequence of displaying the change time of the development agents according to this embodiment, the message to urge a change of the development agents at the timing when the development agents are predicted to be deteriorated is displayed; according thereto, development agents are changed to maintain an image quality and to continue printing. In addition, messages to urge a change of development agents are also displayed at almost the same print interval since that time.

(Another Embodiment)

In another embodiment, a deterioration state of development agents may be determined by use of the following deterioration index of development agents.

Deterioration index of development agent=(previous deterioration index of development agent+$A$)×(1−$B$)×100

Here, A represents a rate of deterioration of development agents from a previous print JOB end to a current print JOB end and is obtained from the following equation. In addition, information of start and end of a print JOB can be obtained from the CPU 801 and the like, for example.

$A$=(driving time counter value of the current print JOB end−driving time counter value of the previous print JOB end)/(driving time counter reference value)

B represents a refreshed rate from a previous print JOB end to a current print JOB end and is obtained from the following equation.

$B$=(supply time counter value of development agent cartridge of the current print JOB end−supply time counter value of the development agent cartridge of the previous print JOB end)/(supply time counter reference value of the development agent cartridge)

Here, the supply time counter reference value of development agent cartridge is a supply time counter value of development agent cartridge which supplies a development agent corresponding to a capacity of one development device to a development device.

In addition, the driving time counter reference value is a driving time counter value of the development device, taken to print until a performance of the development agent reaches a change level without supply of the carrier. Here, it is assumed that the driving time of the development device is a value in an operation mode (so-called an intermittent operation) in which a print stops after printing five sheets and then resumes, not so-called a continuous print.

The deterioration index of development agent is calculated using values of A and B in the previous deterioration index of the development agent and a currently performed print JOB sequence. The former term, (previous deterioration index of development agent+A) represents a rate at which the development agent is stirred in the development device to be deteriorated in the current print JOB, and the latter term, (1−B) represents a rate at which a new development agent is supplied to the development device in the current print JOB but an old development agent remains in the development device without being refreshed.

By multiplying such two terms, (previous deterioration index of development agent+A) and (1−B), a deterioration state of the development agent contained in the development device can be predicted. The sequence of a change display of the development agents using such deterioration index of development agent may be used in place of the performance index of development agent in the above-described embodiment.

Figure 12:
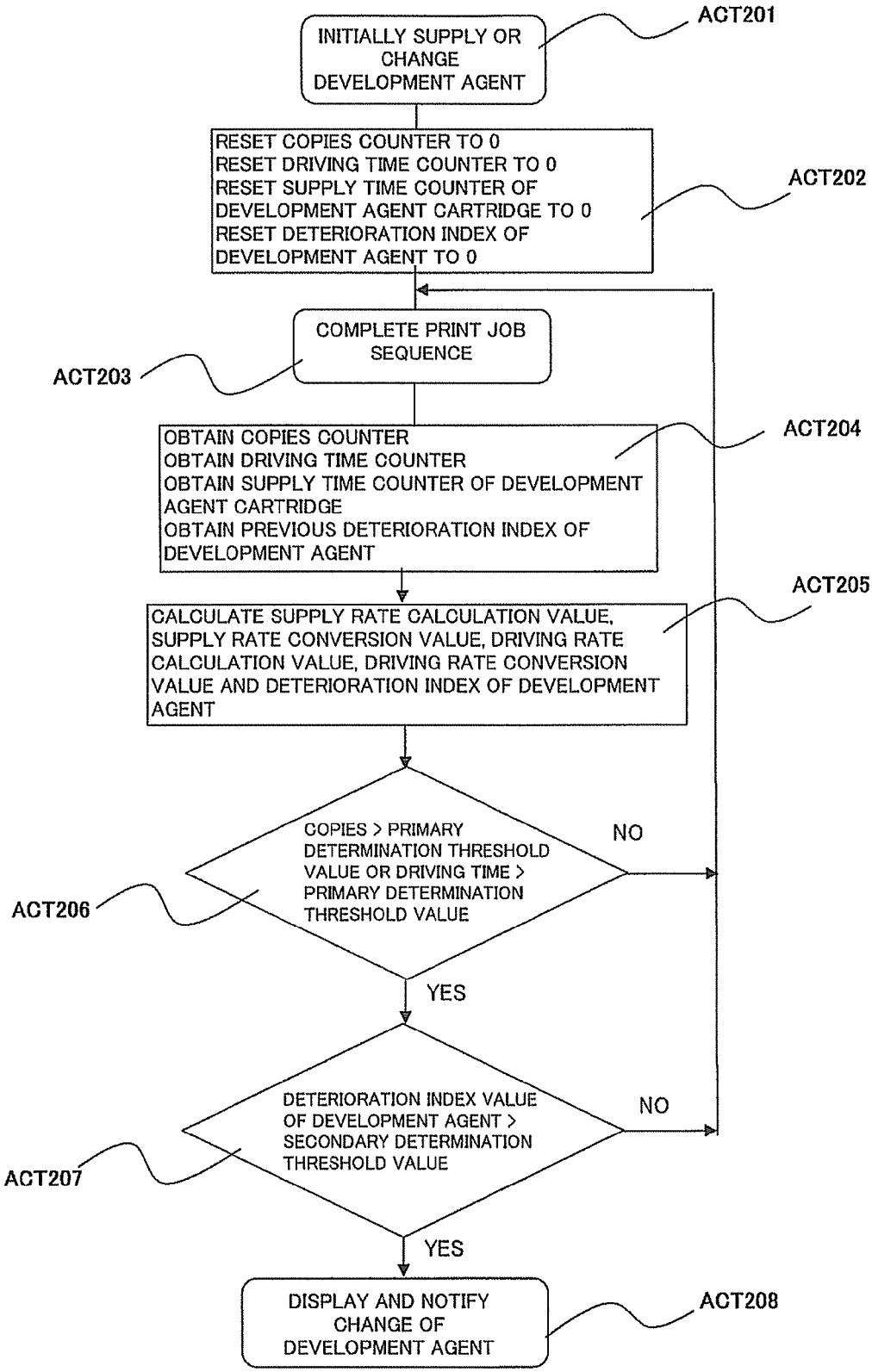
FIG. 12 is a flowchart illustrating an exemplary process which uses a deterioration index of development agent as a determination reference in a sequence of displaying a change timing of a development agent.

FIG. 12 is a flowchart illustrating an exemplary process which uses a deterioration index of development agent as a determination reference in a sequence of displaying a change timing of a development agent.

In the flowchart shown in FIG. 12, when the deterioration index value of development agent is greater than the secondary determination threshold value, it is determined that the development agents are deteriorated up to a state of requiring a change, and display a message asking a change of the development agents on the screen.

Figure 13:
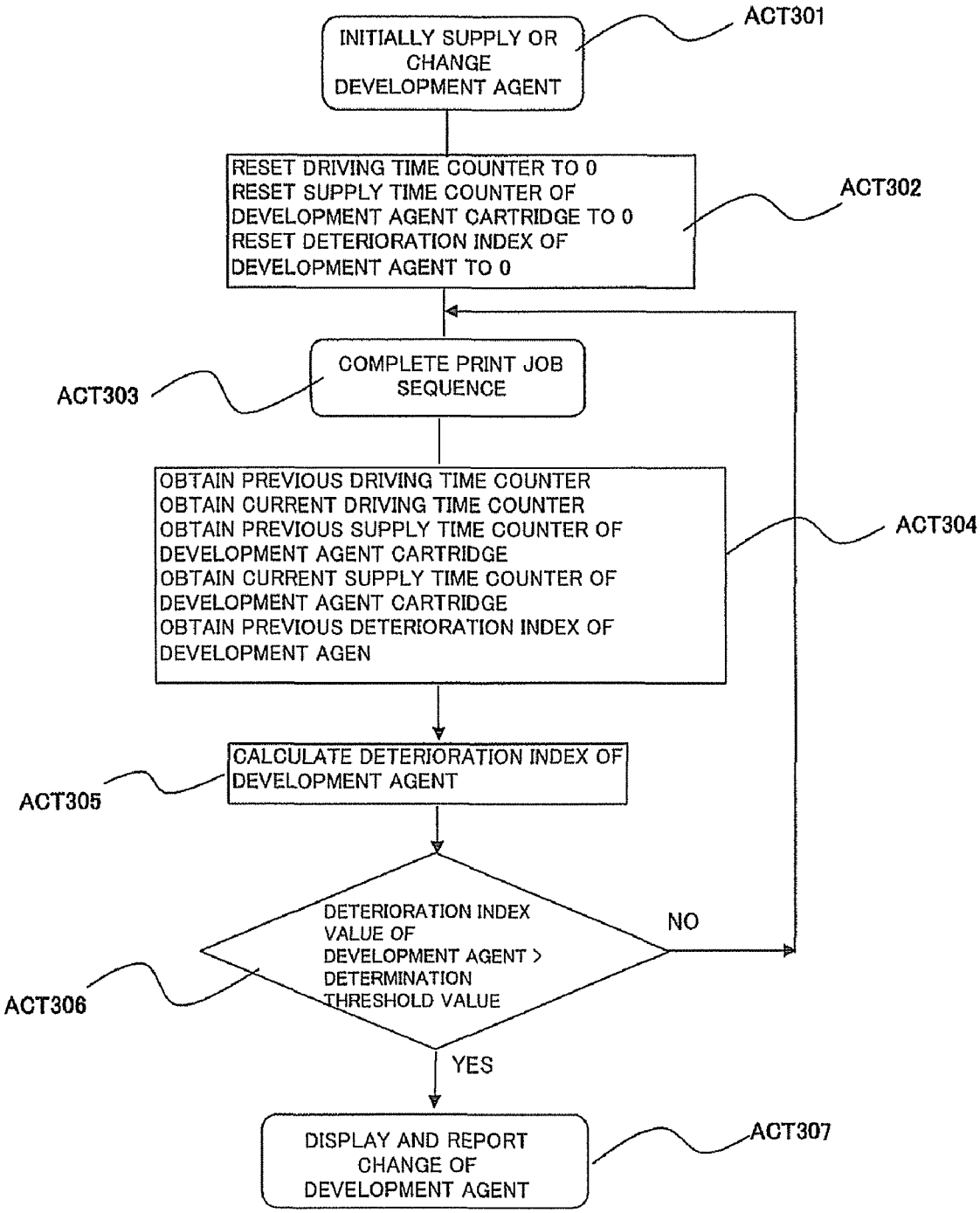
FIG. 13 is a flowchart illustrating a process of determining a deterioration degree of development agent, based on only a deterioration index of development agent without a primary determination, in a sequence of displaying a change timing of a development agent.

FIG. 13 is a flowchart illustrating a determination process of development agent deterioration performed using only the deterioration index of development agent without the primary determination (for example, ACT 206 in FIG. 12 and the like).

A print test under the same condition as the above-described embodiment is performed by use of the change display sequence of the development agents using this deterioration index of development agent and a result almost the same as FIGS. 9 to 11 is obtained.

As described above, according to the above-described embodiments, it is possible to determine a deterioration state of a development agent contained in a development device and thus it can be known whether or not the development agent in the development device is deteriorated up to a level of requiring a change of the development agent. Thereby, the development agents in the development devices can be changed before generating a toner scattering in the development devices or an image deterioration, to maintain a quality of an output image.

Although the above-described embodiments exemplify that the information of a stirring time of the development agents employs the accumulated driving time counter value of a development device or an accumulated copies counter value or the like, for example, an average intermittent ratio (an average value of a rate that represents how long the development devices stop (or driven) during a certain time period) may be employed.

Each operation at the processes by the above-described deterioration degree determining device of development agent is realized by the CPU 801 executing the deterioration degree determining program of development agent stored in the memory 802.

The program for executing each of the above-described operations in a computer (for example, the CPU 801 and the like) configuring the deterioration degree determining section of development agent may be provided as a deterioration degree determining program of development agent. Although the present embodiments exemplify that the corresponding program for realizing a function to embody the invention is pre-recorded in a storage region provided inside the apparatus, but the invention is not limited thereto, the same program may be downloaded to the apparatus from a network or the same program stored in a computer readable recording medium may be installed in the apparatus. A recording medium may be of any types if only it can store a program and is computer readable. Specifically, the recording medium includes, for example, an internal storage device embedded in a computer such as a ROM, a RAM or the like, portable recording media such as a CD-ROM, a flexible disc, a DVD disc, a magneto-optical disc or an IC card, a database to preserve computer programs, or a transmission medium on other computers and a database thereof or a line, or the like. In addition, a function obtained by installation or download in advance may be realized in cooperation with an OS (operating system) of the apparatus.

The program according to the present embodiment is intended to contain a program which dynamically generates an executable module.

Various modifications and alterations of this invention will be apparent to those skilled in the art without departing from the scope and spirit of this invention, and it should be understood that this is not limited to the illustrative embodiments set forth herein.

As described above, according to the present invention, it is possible to provide a technique to accurately grasp a deterioration state of a development agent in a development device, in a development system which supplies a new development agent consisting of a toner and a carrier and discharges an deteriorated development agent to maintain a performance of a development agent in a development device.

Drawings

[FIG. 1]

シート搬送方向 SHEET CARRYING DIRECTION

802 MEMORY

[FIG. 2]

オーバーフロー OVERFLOW

補給 SUPPLY

[FIG. 4]

CPU801 等から FROM CPU801 OR THE LIKE

CPU801 等から FROM CPU801 OR THE LIKE

101 STIRRING INFORMATION OBTAINING SECTION

102 SUPPLY INFORMATION OBTAINING SECTION

103 DETERIORATION DEGREE DETERMINING SECTION

104 NOTICE CONTROL SECTION

ディスプレイ、スピーカ等へ TO DISPLAY, SPEAKER AND SO FORTH

[FIG. 5]

ACT101 INITIALLY SUPPLY OR CHANGE DEVELOPMENT AGENT

ACT102

RESET COPIES COUNTER TO 0

RESET DRIVING TIME COUNTER TO 0

RESET SUPPLY TIME COUNTER OF DEVELOPMENT AGENT CARTRIDGE TO 0

ACT103

COMPLETE PRINT JOB SEQUENCE

ACT104

OBTAIN COPIES COUNTER

OBTAIN DRIVING TIME COUNTER

OBTAIN SUPPLY TIME COUNTER OF DEVELOPMENT AGENT CARTRIDGE

ACT105

CALCULATE SUPPLY RATE CALCULATION VALUE, SUPPLY RATE CONVERSION VALUE, DRIVING RATE CALCULATION VALUE, DRIVING RATE CONVERSION VALUE, PERFORMANCE INDEX CALCULATION VALUE OF DEVELOPMENT AGENT, AND PERFORMANCE INDEX CONVERSION VALUE OF DEVELOPMENT AGENT

ACT106

COPIES>PRIMARY DETERMINATION THRESHOLD VALUE OR DRIVING TIME>PRIMARY DETERMINATION THRESHOLD VALUE

ACT107

PERFORMANCE INDEX CONVERSION VALUE OF DEVELOPMENT AGENT<SECONDARY DETERMINATION THRESHOLD VALUE

ACT108

DISPLAY AND NOTIFY CHANGE OF DEVELOPMENT AGENT

[FIG. 6]

単位 ＪＯＢ 印刷 2 枚 PRINT JOB UNIT TWO SHEETS

印刷枚数 COPIES

印字率 PRINT RATIO

印字率 PRINT RATIO

印字率 PRINT RATIO

印字率 PRINT RATIO

[FIG. 7]

印刷 ＪＯＢ 単位 5 枚 PRINT JOB UNIT FIVE SHEETS

印刷枚数 COPIES

印字率 PRINT RATIO

印字率 PRINT RATIO

印字率 PRINT RATIO

印字率 PRINT RATIO

[FIG. 8]

印刷 ＪＯＢ 単位 1 0 枚 PRINT JOB UNIT TEN SHEETS

印刷枚数 COPIES

印字率 PRINT RATIO

印字率 PRINT RATIO

印字率 PRINT RATIO

印字率 PRINT RATIO

[FIG. 9]

印刷 ＪＯＢ 単位 2 枚 PRINT JOB UNIT TWO SHEETS

印刷枚数 COPIES

印字率 PRINT RATIO

印字率 PRINT RATIO

印字率 PRINT RATIO

印字率 PRINT RATIO

[FIG. 10]

印刷 ＪＯＢ 単位 5 枚 PRINT JOB UNIT FIVE SHEETS

印刷枚数 COPIES

印字率 PRINT RATIO

印字率 PRINT RATIO

印字率 PRINT RATIO

印字率 PRINT RATIO

[FIG. 11]

印刷 ＪＯＢ 単位 1 0 枚 PRINT JOB UNIT TEN SHEETS

印刷枚数 COPIES

印字率 PRINT RATIO

印字率 PRINT RATIO

印字率 PRINT RATIO

印字率 PRINT RATIO

[FIG. 12]
ACT201
INITIALLY SUPPLY OR CHANGE DEVELOPMENT AGENT
ACT202
RESET COPIES COUNTER TO 0
RESET DRIVING TIME COUNTER TO 0
RESET SUPPLY TIME COUNTER OF DEVELOPMENT AGENT CARTRIDGE TO 0
RESET DETERIORATION INDEX OF DEVELOPMENT AGENT TO 0
ACT203
COMPLETE PRINT JOB SEQUENCE
ACT204
OBTAIN COPIES COUNTER
OBTAIN DRIVING TIME COUNTER
OBTAIN SUPPLY TIME COUNTER OF DEVELOPMENT AGENT CARTRIDGE
OBTAIN PREVIOUS DETERIORATION INDEX OF DEVELOPMENT AGENT
ACT205
CALCULATE SUPPLY RATE CALCULATION VALUE, SUPPLY RATE CONVERSION VALUE, DRIVING RATE CALCULATION VALUE, DRIVING RATE CONVERSION VALUE AND DETERIORATION INDEX OF DEVELOPMENT AGENT
ACT206
COPIES>PRIMARY DETERMINATION THRESHOLD VALUE OR DRIVING TIME>PRIMARY DETERMINATION THRESHOLD VALUE
ACT207
DETERIORATION INDEX VALUE OF DEVELOPMENT AGENT>SECONDARY DETERMINATION THRESHOLD VALUE
ACT208
DISPLAY AND NOTIFY CHANGE OF DEVELOPMENT AGENT
[FIG. 13]
ACT301
INITIALLY SUPPLY OR CHANGE DEVELOPMENT AGENT
ACT302
RESET DRIVING TIME COUNTER TO 0
RESET SUPPLY TIME COUNTER OF DEVELOPMENT AGENT CARTRIDGE TO 0
RESET DETERIORATION INDEX OF DEVELOPMENT AGENT TO 0
ACT303
COMPLETE PRINT JOB SEQUENCE
ACT304
OBTAIN PREVIOUS DRIVING TIME COUNTER
OBTAIN CURRENT DRIVING TIME COUNTER
OBTAIN PREVIOUS SUPPLY TIME COUNTER OF DEVELOPMENT AGENT CARTRIDGE
OBTAIN CURRENT SUPPLY TIME COUNTER OF DEVELOPMENT AGENT CARTRIDGE
OBTAIN PREVIOUS DETERIORATION INDEX OF DEVELOPMENT AGENT
ACT305
CALCULATE DETERIORATION INDEX OF DEVELOPMENT AGENT
ACT306
DETERIORATION INDEX VALUE OF DEVELOPMENT AGENT>DETERMINATION THRESHOLD VALUE
ACT307
DISPLAY AND NOTIFY CHANGE OF DEVELOPMENT AGENT

What is claimed is:

1. An image forming apparatus, which supplies a new development agent consisting of a toner and a carrier and discharges a deteriorated development agent to maintain a performance of a development agent in a development device, comprising:

a stirring information obtaining section configured to obtain information of a stirring time of the development agent in the development device;

a supply information obtaining section configured to obtain information of an amount of the carrier supplied into the development device; and a deterioration degree determining section configured to determine a deterioration degree of the development agent in the development device on the basis of the information obtained by the stirring information obtaining section and the supply information obtaining section, and determine the development agent contained in the development device reaches its change time when a deterioration index value of development agent is greater than a predetermined threshold value, where the deterioration index of development agent=(previous deterioration index of development agent +A)×(1−B)×100, the deterioration index of development agent representing a deterioration degree of a development agent, where A is a rate of deterioration from a previous print JOB end to a current print JOB end and B is a refreshed rate from a previous print JOB end to a current print JOB end.

2. The apparatus according to claim 1, wherein the rate A and the rate B are obtained from the following equations:

$A$=(driving time counter value of the current print JOB end−driving time counter value of the previous print JOB end)/(predetermined driving time counter reference value);

$B$=(supply time counter value of development agent cartridge of the current print JOB end−supply time counter value of the development agent cartridge of the previous print JOB end)/(predetermined supply time counter reference value of the development agent cartridge).

3. The apparatus according to claim 1, further comprising a notice control section configured to notify a user of the development agent contained in the development device reaching its change time when the deterioration degree determined by the deterioration degree determining section exceeds a predetermined level.

4. A method of determining a deterioration degree of a development agent consisting of a toner and a carrier and discharges a deteriorated development agent to maintain a performance of the development agent in the development device, comprising:

obtaining information of a stirring time of the development agent in the development device;

obtaining information of an amount of the carrier supplied into the development device; and determining the deterioration degree of the development agent in the development device on the basis of the obtained information of a stirring time of the development agent and the information of a supply amount of the carrier, wherein the step of determining further determines the development agent contained in the development device reaches its change time when a deterioration index value of development agent is greater than a predetermined threshold value, where the deterioration index of development agent=(previous deterioration index of development agent+A)×(1−B)×100, the deterioration index of development agent representing a deterioration degree of a development agent, where A is a rate of deterioration from a previous print JOB end to a current print JOB end and B is a refreshed rate from a previous print JOB end to a current print JOB end.

5. The method according to claim 4, wherein the rate A and the rate B are obtained from the following equations: A=(driving time counter value of the current print JOB end−driving time counter value of the previous print JOB end)/(predetermined driving time counter reference value); B=(supply time counter value of development agent cartridge of the current print JOB end−supply time counter value of the development agent cartridge of the previous print JOB end)/(predetermined supply time counter reference value of the development agent cartridge).

6. The method according to claim 4, further comprising notifying a user of the development agent contained in the development device reaching its change time when the determined deterioration degree exceeds a predetermined level.

7. A program of determining a deterioration degree of a development agent which causes a computer to determine the deterioration degree of the development agent, in a development system which supplies a new development agent consisting of a toner and a carrier and discharges a deteriorated development agent to maintain a performance of a development agent in a development device, the program causing the computer to:

obtain information of a stirring time of the development agent in the development device;

obtain information of an amount of the carrier supplied into the development device; and determine a deterioration degree of the development agent in the development device on the basis of the obtained information of a stirring time of the development agent and the information of a supply amount of the carrier, further enabling the computer to determine the development agent contained in the development device reaches its change time when a deterioration index value of development agent is greater than a predetermined threshold value, where the deterioration index of development agent=(previous deterioration index of development agent+A)×(1−B)×100, the deterioration index of development agent representing a deterioration degree of a development agent, where A is a rate of deterioration from a previous print JOB end to a current print JOB end and B is a refreshed rate from a previous print JOB end to a current print JOB end.

8. The program according to claim 7, wherein the rate A and the rate B are obtained from the following equations: A=(driving time counter value of the current print JOB end−driving time counter value of the previous print JOB end)/(predetermined driving time counter reference value); B=(supply time counter value of development agent cartridge of the current print JOB end−supply time counter value of the development agent cartridge of the previous print JOB end)/(predetermined supply time counter reference value of the development agent cartridge).

9. The program according to claim 7, further causing the computer to notify a user of the development agent contained in the development device reaching its change time when the determined deterioration degree exceeds a predetermined level.

10. The apparatus according to claim 2, further comprising a notice control section configured to notify a user of the development agent contained in the development device reaching its change time when the deterioration degree determined by the deterioration degree determining section exceeds a predetermined level.

11. The method according to claim 5, further comprising notifying a user of the development agent contained in the development device reaching its change time when the determined deterioration degree exceeds a predetermined level.

12. The program according to claim 8, further causing the computer to notify a user of the development agent contained in the development device reaching its change time when the determined deterioration degree exceeds a predetermined level.

* * * * *